US006802243B2

(12) United States Patent
Matsuda et al.

(10) Patent No.: US 6,802,243 B2
(45) Date of Patent: Oct. 12, 2004

(54) WOBBLE TYPE FLUID PUMP HAVING SWING SUPPORT MECHANISM

(75) Inventors: Mikio Matsuda, Okazaki (JP); Mitsuo Inagaki, Okazaki (JP); Shigeru Hisanaga, Kariya (JP); Naruhide Kimura, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 09/977,232

(22) Filed: Oct. 16, 2001

(65) Prior Publication Data

US 2002/0046645 A1 Apr. 25, 2002

(30) Foreign Application Priority Data

| | | |
|---|---|---|
| Oct. 20, 2000 | (JP) | 2000-321191 |
| Mar. 5, 2001 | (JP) | 2001-060654 |
| Jul. 4, 2001 | (JP) | 2001-203659 |

(51) Int. Cl.[7] ..... F01B 3/04
(52) U.S. Cl. ..... 92/12.2
(58) Field of Search ..... 92/12.2, 71; 248/661, 248/913

(56) References Cited

U.S. PATENT DOCUMENTS

| | | | | |
|---|---|---|---|---|
| 3,761,202 A | * | 9/1973 | Mitchell | 417/269 |
| 4,221,545 A | * | 9/1980 | Terauchi | 417/269 |
| 4,576,554 A | | 3/1986 | Wagenseil et al. | |
| 4,858,480 A | | 8/1989 | Rohde et al. | |
| 5,079,996 A | | 1/1992 | Abousabha et al. | 92/12.2 |
| 5,509,346 A | | 4/1996 | Kumpf | 92/12.2 |

FOREIGN PATENT DOCUMENTS

| | | |
|---|---|---|
| FR | 1344108 | 11/1963 |
| JP | A-61-218783 | 9/1986 |
| JP | A-63-94085 | 4/1988 |
| JP | A-2-275070 | 11/1990 |
| WO | WO 00/53927 | 9/2000 |

OTHER PUBLICATIONS

"Gimbal" in:Van Nostrand's Scientific Encyclopedia (1995) p. 1462.*

* cited by examiner

*Primary Examiner*—F. Daniel Lopez
(74) *Attorney, Agent, or Firm*—Posz & Bethards, PLC

(57) ABSTRACT

A swing member is supported by a swing support member like a universal joint of a Hook's type such that it can swing in a state where it is prevented from rotating around a center line. In this manner, even if a shaft rotates at high speed, the swing member is surely prevented from rotating around the shaft. Therefore, it is possible to prevent a piston from excessively vibrating, hence to prevent large noises from being made, and to improve reliability and durability of a compressor when the compressor is operated at high speed.

7 Claims, 17 Drawing Sheets

WOBBLE TYPE FLUID PUMP HAVING SWING SUPPORT MECHANISM

CROSS REFERENCE TO RELATED APPLICATION

This application is based on and incorporates herein by reference Japanese Patent Application Nos. 2000-321191 filed on Oct. 20, 2000, 2001-60654 filed on Mar. 5, 2001, and 2001-203659 filed on Jul. 4, 2001.

BACKGROUND OF THE INVENTION

1. Field of the Invention

The present invention relates to a wobble type fluid pump suitable for use in a refrigeration cycle for a vehicle.

2. Description of Related Art

JP-A-63-94085 discloses a wobble type pump including a rotating member having a slant plane, which is slanted with respect to a shaft and is integrally rotated with the shaft, and a swing member which is connected to the slant plane through a thrust bearing and is swung with the rotation of the rotating member to reciprocate a piston.

In the wobble pump, a swing support mechanism supports the swing member such that it can swing by engaging a bevel gear provided on the rotating member with a bevel gear provided on the swing member. Thus, when a pump is operated, it tends to make noises by the engagement of the teeth of the bevel gears.

JP-A-2-275070 also discloses a wobble type pump. In the wobble type pump, since a swing member is supported by a spherical sliding part at the outer peripheral side of the swing member, the noises produced by engagement of the teeth of the gears is reduced. However, an inertia moment of the swing member is increased, that is, the inertia moment in a rotational direction of the swing member is increased because the spherical sliding part is disposed at the outer peripheral side of the swing member.

Thus, when a shaft rotates at high speeds, the swing member is swung by a force for rotating the swing member around the shaft such that the swing member turns around the shaft to excessively vibrate a piston, which results in presenting problems of making large noises and reducing reliability and durability of the pump at high rotational speeds.

SUMMARY OF THE INVENTION

An object of the present invention is to suppress a vibration of a swing member and a movable member such as a piston at high rotational speed in a fluid pump.

According to the present invention, a swing support mechanism includes a first rotating member capable of rotating around a first axis (L1) perpendicular to a center line (Lo) of a shaft. A constraining member is connected to a first rotating member and restraining the first rotating member from rotating around the center line (Lo). A second rotating member is connected to the first rotating member such that the second rotating member rotates around a second axis (L2) perpendicular to the center line (Lo) and crossing the first axis (L1). The swing member is connected to the second rotating member.

Since the swing member is supported by the swing support member such that it can swing in a state where it is prevented from rotating around the center line (Lo), even if the shaft rotates at high speed, the swing member is surely prevented from rotating around the shaft.

Therefore, it is possible to prevent the piston from excessively vibrating, hence to prevent large noises from being made, and to improve reliability and durability of the pump at high rotational speed.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
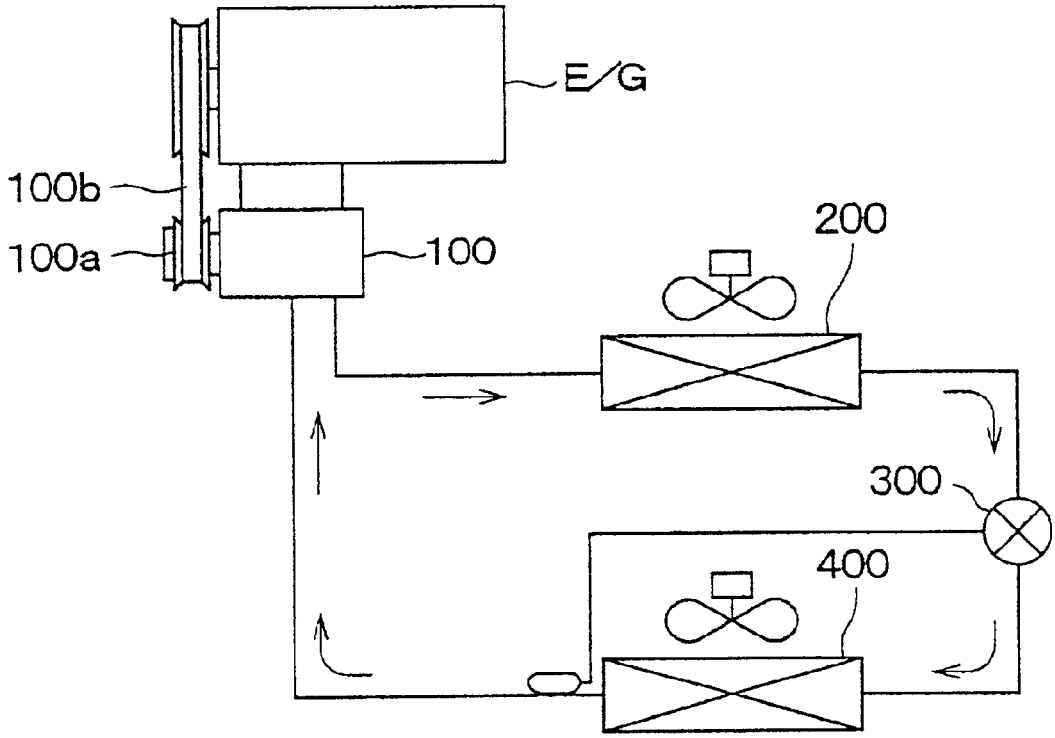
FIG. 1 is a schematic view showing a compression type refrigeration cycle (first embodiment)

FIG. 1 is a schematic view showing a steam compression type refrigeration cycle for a vehicle.

In FIG. 1, a compressor 100 receives a rotating force from an engine E/G for running, and sucks and compresses a refrigerant. An electromagnetic clutch 100*a* intermittently transmits the rotating force of the engine E/G to the compressor 100. Here, a V-belt 100*b* transmits the rotating force from the engine E/G to the compressor 100.

A condenser 200 heat exchanges between a refrigerant discharged from the compressor 100 and the outside air to condense the refrigerant. A pressure reducing unit 300 reduces the pressure of the refrigerant flowing out of the condenser 200. An evaporator 400 heat exchanges between the refrigerant of which pressure is reduced by the pressure reducing unit 300 and air blown into a vehicle compartment to evaporate the refrigerant and cool the air blown into the vehicle compartment.

In the present embodiment, a thermal expansion valve is adopted as the pressure reducing unit 300 for adjusting the super heat of the refrigerant sucked by the compressor 100 to be at a predetermined value.

Figure 2:
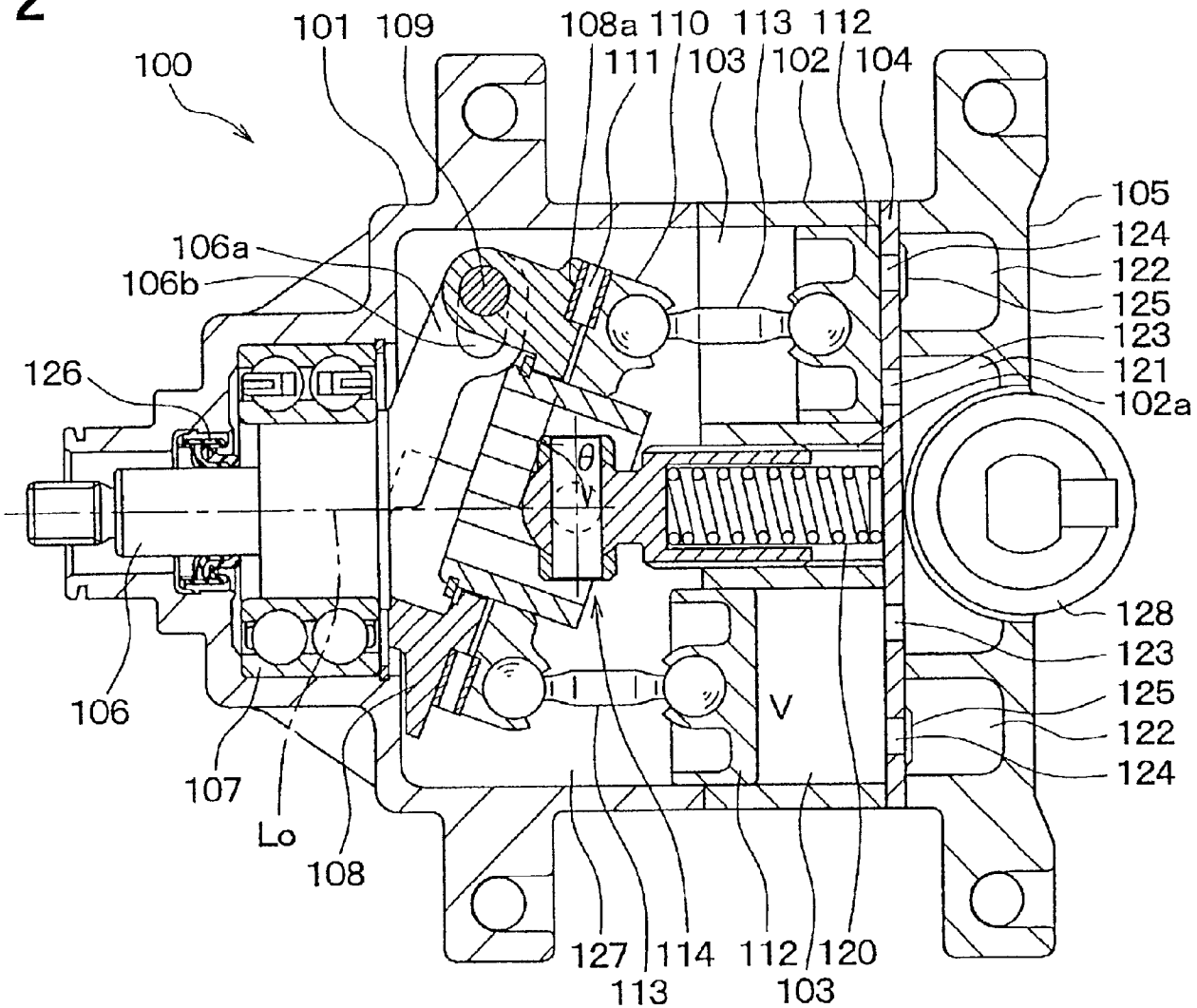
FIG. 2 is a cross-sectional view showing a compressor (first embodiment)

FIG. 2 is a cross-sectional view in the axial direction of the compressor 100. A front housing 101 is made of aluminum. In a middle housing 102, a plurality of cylinder bores 103 (five cylinder bores in the present embodiment) are made. A valve plate 104 closes the one end sides of the cylinder bores 103 and is fixed between the middle housing 102 and a rear housing 105. Then, in the present embodiment, the front housing 101, the middle housing 102, and the rear housing 105 form a housing of the compressor 100.

A shaft 106 rotates when a driving force from a vehicle engine (not illustrated) is applied. The shaft 106 is rotatably supported in the housing through a radial bearing 107.

A orbiting member 108 is connected to the rear end side of an arm 106*a* integrally formed with the shaft 106. The orbiting member 108 is integrally rotated with the shaft 106 and has a slant surface 108*a* slanting with respect to the shaft 106.

In this connection, a connection pin 109 constitutes a hinge mechanism for connecting the orbiting member 108 to the arm 106*a* such that the orbiting member 108 can swing. A hole 106*b* is formed in the arm 106*a* side of the shaft 106, and the connection pin 109 is inserted into the hole 106*b*. The hole 106*b* is formed in an oval such as an ellipse.

Figure 6:
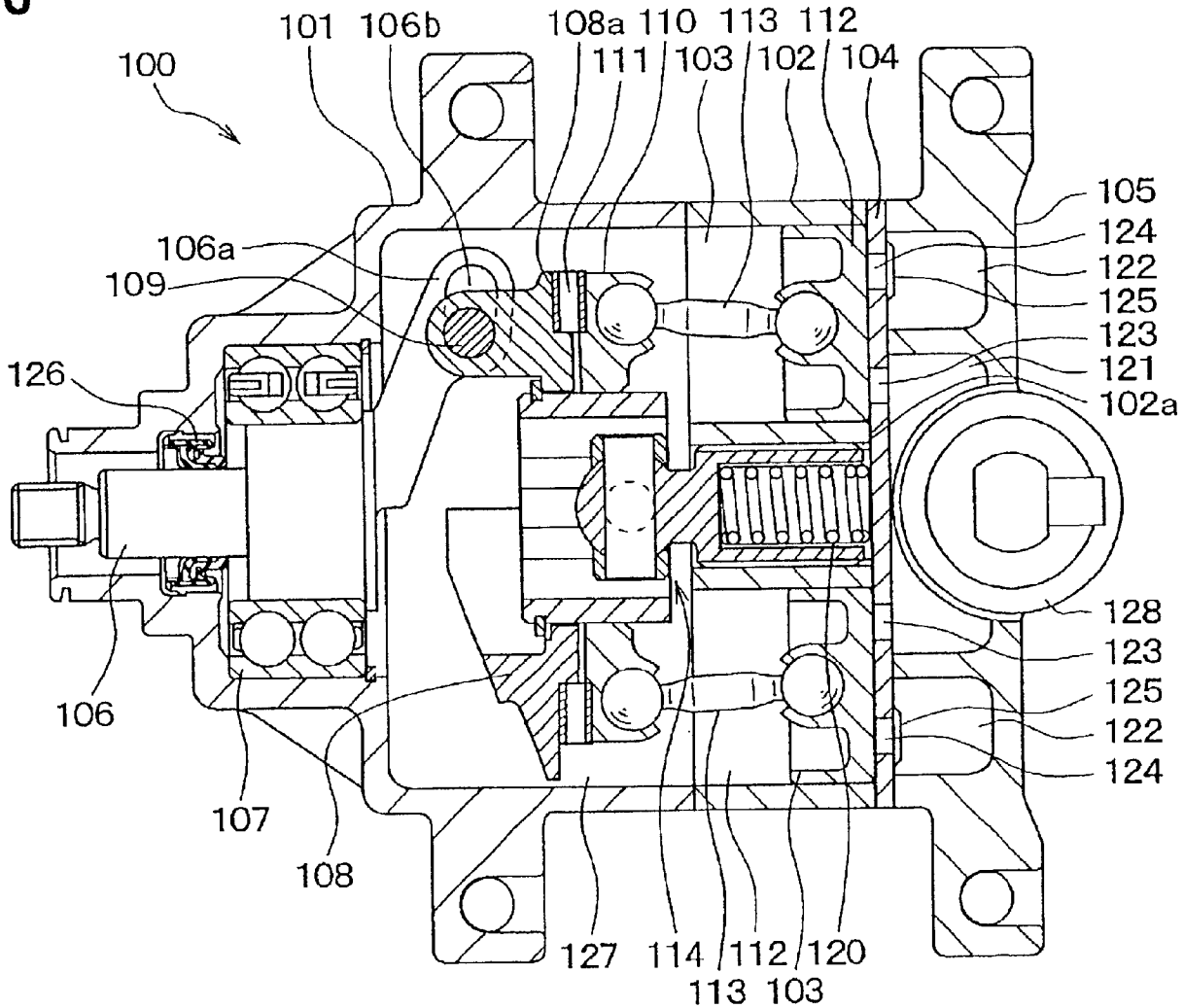
FIG. 6 is a cross-sectional view showing the compressor being operated at a minimum discharge capacity (first embodiment)

Thus, as will be described later (see FIG. 6), when a slant angle θ (which is formed by the slant surface 108*a* and the center line Lo of the shaft 106) is changed, the connection pin 109 slides in the direction of an longitudinal diameter.

A swing member 110 is shaped like a ring disc, and is connected to the slant surface 108*a* through a thrust bearing 111. The swing member 110 is swung with the rotation of the orbiting member 108 such that its outer peripheral side waves.

Here, the thrust bearing 111 is a bearing for allowing the orbiting member 108 to rotate around an axis perpendicular to the slant surface 108*a* with respect to the swing member 110, and a roller bearing having nearly cylindrically formed rollers is used in the present embodiment.

A piston 112 reciprocates in the cylinder bore 103, and a rod 113 connects the piston 112 to the swing member 110. Here, the one end side of the rod 113 is connected to the outer peripheral side of the swing member 110 such that it can swing, and the other end side is connected to the piston 112 such that it can swing. Thus, when the shaft 106 rotates to swing the swing member 110, the piston 112 reciprocates in the cylinder bore 103.

A swing support mechanism 114 is disposed near the center of the swing member 110. The swing support mechanism 114 is shaped like a universal joint and supports the swing member 110 such that it can swing. The swing support mechanism 114 will be described with reference to FIGS. 3–5.

Figure 3:
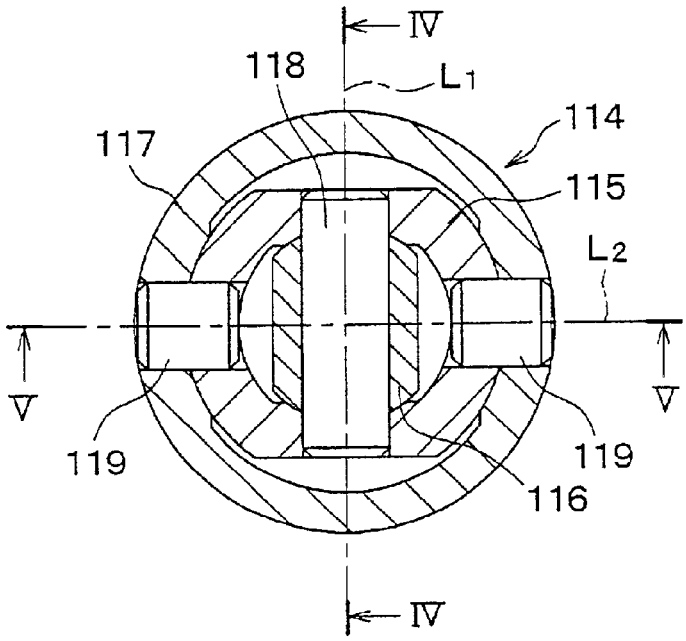
FIG. 3 is a cross-sectional view showing a swing support mechanism (first embodiment)
Figure 4:
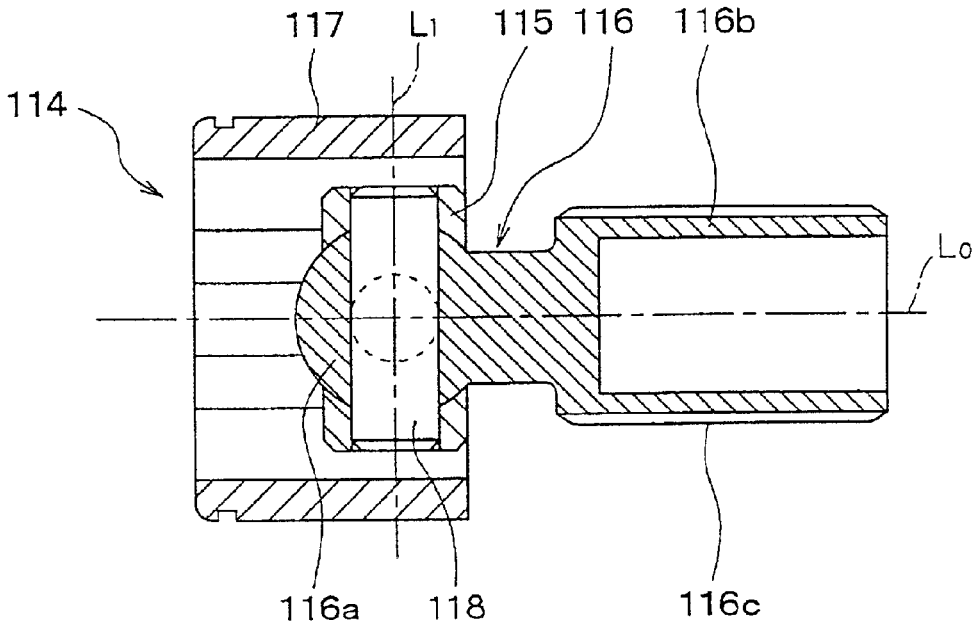
FIG. 4 is a cross-sectional view taken along line IV—IV in FIG. 3 (first embodiment)
Figure 5:
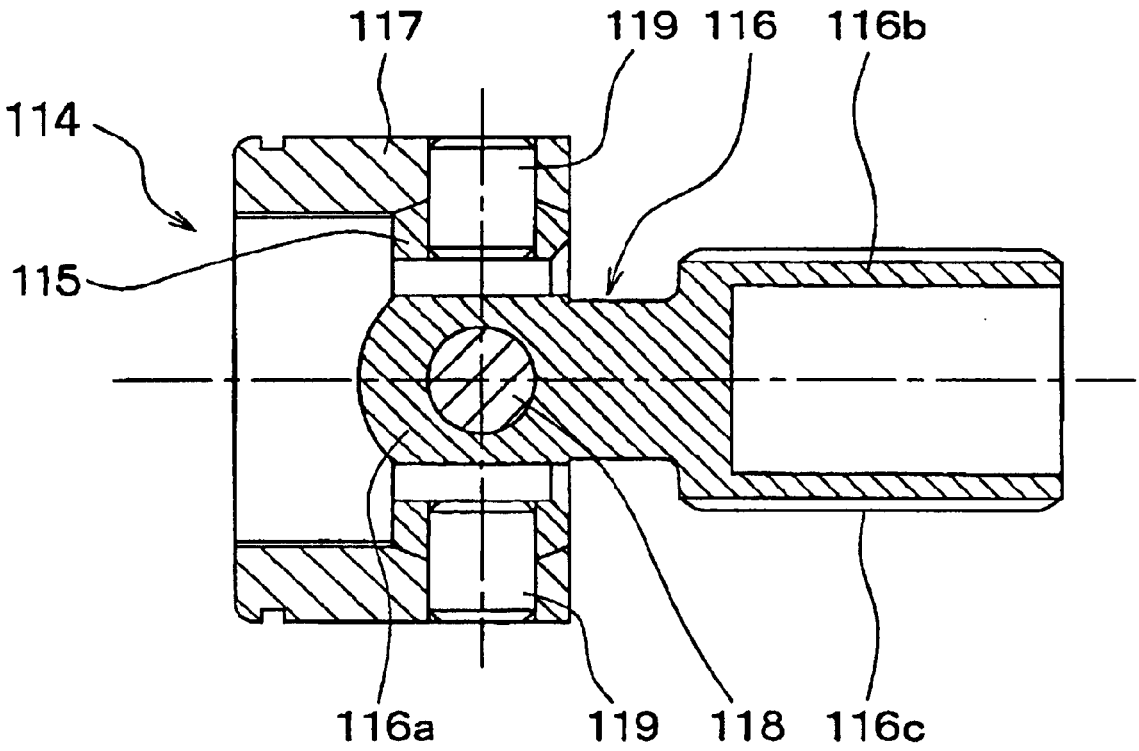
FIG. 5 is a cross-sectional view taken along line V—V in FIG. 3 (first embodiment)

FIG. 3 is a view of the swing support mechanism 114 when it is viewed from the shaft 106 side, FIG. 4 is a cross-sectional view taken along line IV—IV in FIG. 3, and FIG. 5 is a cross-sectional view taken along line V—V in FIG. 3. A first rotating member 115 is formed in a ring and is capable of rotating around a first axis L1 perpendicular to the center line Lo of the shaft 106. A constraining member 116 is connected to the first rotating member 115 to prevent the first rotating member 115 from rotating around the center line Lo.

The constraining member 116, as shown in FIG. 4, has a spherical sliding part 116*a* positioned in the inner peripheral surface of the first rotating member 115 and a support part 116*b* nearly shaped like a cylinder. On the outer peripheral surface of the support part 116*b*, a spline 116*c* is made. The spline 116*c* is formed of many grooves extending in the axial direction of the constraining member 116 and whose cross section is formed in a gear. On the other hand, in the position near to the center of the middle housing 102, as shown in FIG. 2, a hole 102*a* is formed. The hole 102*a* has a cross section similar to the cross section of the constraining member 116.

When the constraining member 116 is slidably inserted into the hole 102*a*, the constraining member 116 is engaged with the middle housing 102 such that it can slide in the direction of the center line Lo in the state and it can not rotate with respect to the middle housing 102.

Further, in FIG. 3, a second rotating member 117 is formed in a ring, and is positioned outside in the radial direction of the first rotating member 115. The second rotating member 117 is connected to the first rotating member 115 such that it can rotate around the second axis L2 perpendicular to the center line Lo and to the first axis L1. The swing member 110 is connected to the second rotating member 117 in the state where the swing member 110 is press-inserted into the second rotating member 117.

In this connection, the first rotating member 115 is connected to the constraining member 116 through a first pin 118, and the second rotating member 117 is connected to the first rotating member 115 through two second pins 119. Further, as shown in FIG. 2, in the constraining member 116, a coil spring 120 is disposed for exerting an elastic force to press the swing support member 114 toward the shaft 106.

As described above, the swing support member 114 constitutes a universal joint like a Hook's joint, so that it can support and allow the swing member 110 to swing.

Here, in FIG. 2, a suction chamber 121 distributes and supplies a refrigerant to a plurality of operating chambers V formed by the cylinder bores 103, the valve plate 104 and the pistons 112. In the valve plate 104, suction ports 123 are made for allowing the suction chamber 121 to communicate with the operating chamber V, and discharge ports 124 are made for allowing the operating chamber V to communicate with a discharge chamber 122.

The suction port 123 is provided with a suction valve (not illustrated) shaped like a reed valve for preventing the refrigerant from inversely flowing from the operating chamber V to the suction chamber 121, and the discharge port 124 is provided with a discharge valve (not illustrated) shaped like a reed valve for preventing the refrigerant from inversely flowing from the discharge chamber 122 to the operating chamber V.

In this respect, the suction valve and the discharge valve are fixed, with a valve stopper 125 for restraining the maximum opening of the discharge valve, between the middle housing 102 and the rear housing 105.

Here, a shaft seal 126 prevents the refrigerant in the crankcase 127 in which the swing member 110 is accommodated from leaking outside the housing through the gap between the front housing 101 and the shaft 106, and a pressure control valve 128 controls the pressure in the crankcase 127 by adjusting the communication state among the crankcase 127, the suction chamber 121 and the discharge chamber 122.

Next, an operation of the compressor 100 will be described.

1. When the compressor is operated at a maximum discharge capacity (see FIG. 2).

The pressure in the crankcase 127 is made lower than a discharge pressure by adjusting the pressure control valve 128. At this time, paying attention to the piston 112 during a compression stroke out of the five pistons 112, a compressive reactive force to increase the volume of the operating chamber V is applied to the swing member 110 and the orbiting member 108, because the pressure in the operating chamber V is larger than the pressure in the crankcase 127.

Since the swing member 110 is constrained by the swing support member 114, slant moment in the direction to reduce the slanting angle θ is applied to the swing member 110 and the rotating member 108 by a compressive reactive force having a center thereof at the connecting pin 109. Thus, the slanting angle θ of the swing member 110 is decreased to increase the stroke of the piston 112, thereby increasing the discharge capacity.

Here, the discharge capacity of the compressor means theoretical volumetric flow discharged when the shaft 106 rotates by one rotation.

2. When the compressor is operated at a variable discharge capacity (see FIG. 6).

The pressure in the crankcase 127 is increased as compared with the case where the compressor is operated at the maximum discharge capacity by adjusting the pressure control valve. Thus, the compressive reactive force is decreased, which is contrary to the case where the compressor is operated at the maximum discharge capacity. Therefore, the slant angle is increased and hence the discharge capacity is decreased.

According to the present embodiment, since the swing member 110 is supported by the swing support member 114 such that it can swing in the state where it is prevented from rotating around the center line Lo, even when the shaft 106 rotates at high speeds, the swing member 110 is surely prevented from being swung around the shaft 106.

Therefore, it is possible to prevent the piston 112 from being extensively vibrated and hence to prevent large noises from being made and to improve reliability and durability of the compressor 100 at high rotational speeds.

Further, the swing support member 114 is disposed near the center of the swing member 110. Thus, the inertia moment of the swing member 110 can be reduced. The outside diameter of the compressor 100 can be reduced as compared with a compressor in which an automatic prevention mechanism for restricting the swing member 110 from rotating is disposed at the outer peripheral side of the swing member 110, which is described in JP-A-61-218783 for example. Further, a dynamic balance is not lost when the swing member 110 is swung. Therefore, it is possible to reduce the outside diameter of the compressor 100 and at the same time to smoothly swing the swing member 110.

(Second Embodiment)

The present invention is applied to a variable capacity type compressor capable of changing the slant angle θ in the first embodiment. In the second embodiment, the present invention, as shown in FIG. 7, is applied to a fixed capacity type compressor having the fixed slant angle θ.

Figure 7:
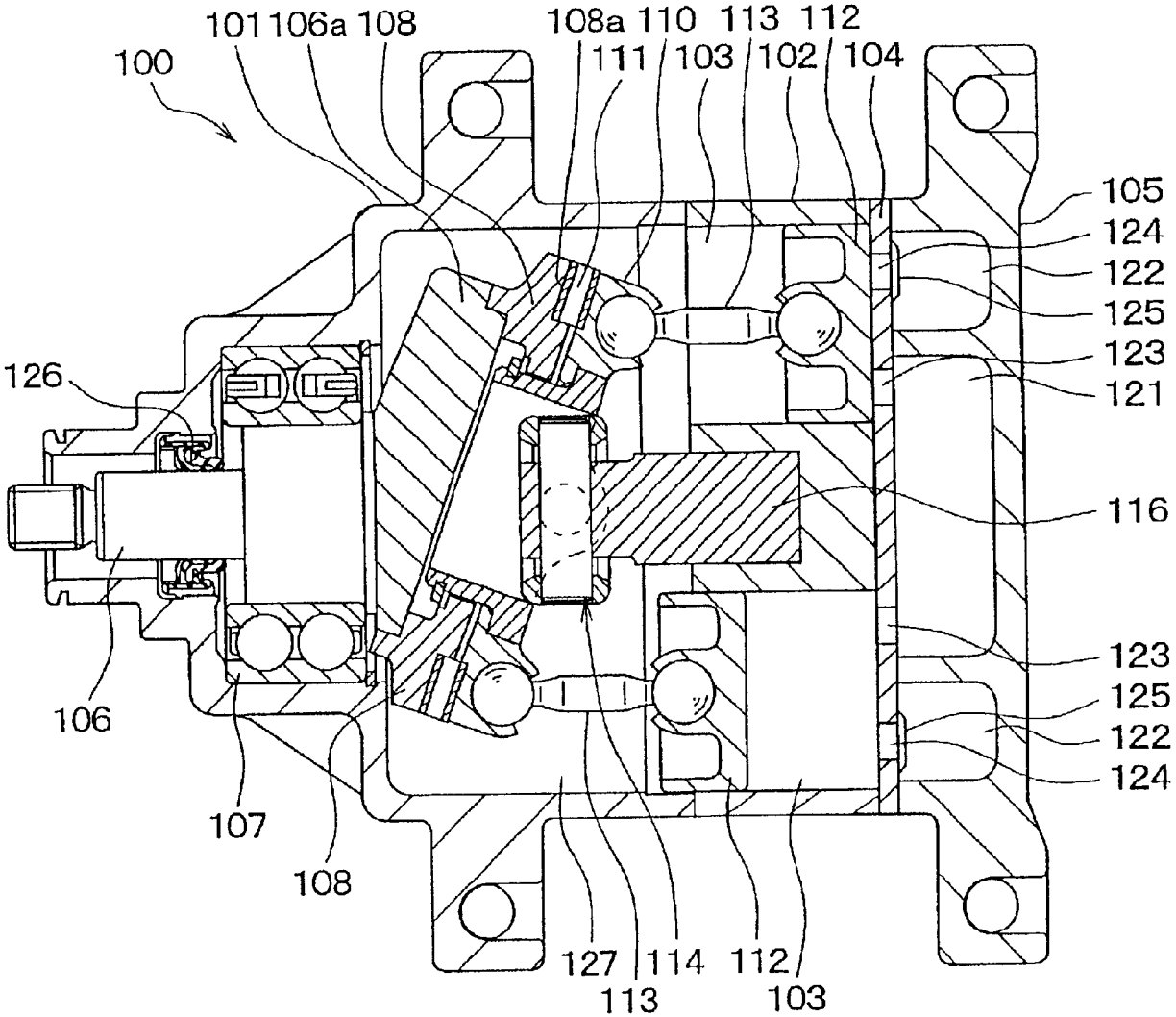
FIG. 7 is a cross-sectional view showing a compressor (second embodiment)

In the fixed capacity type compressor, as shown in FIG. 7, the constraining member 116 of the swing support member 114 may be fixed in a state where it can not move with respect to the middle housing 102, and as shown in FIG. 2, if it is fixed in a state where it can move, it can absorb irregularity in size and in assembling of the swinging member 110 and the rotating member 108.

(Third Embodiment)

Figure 8:
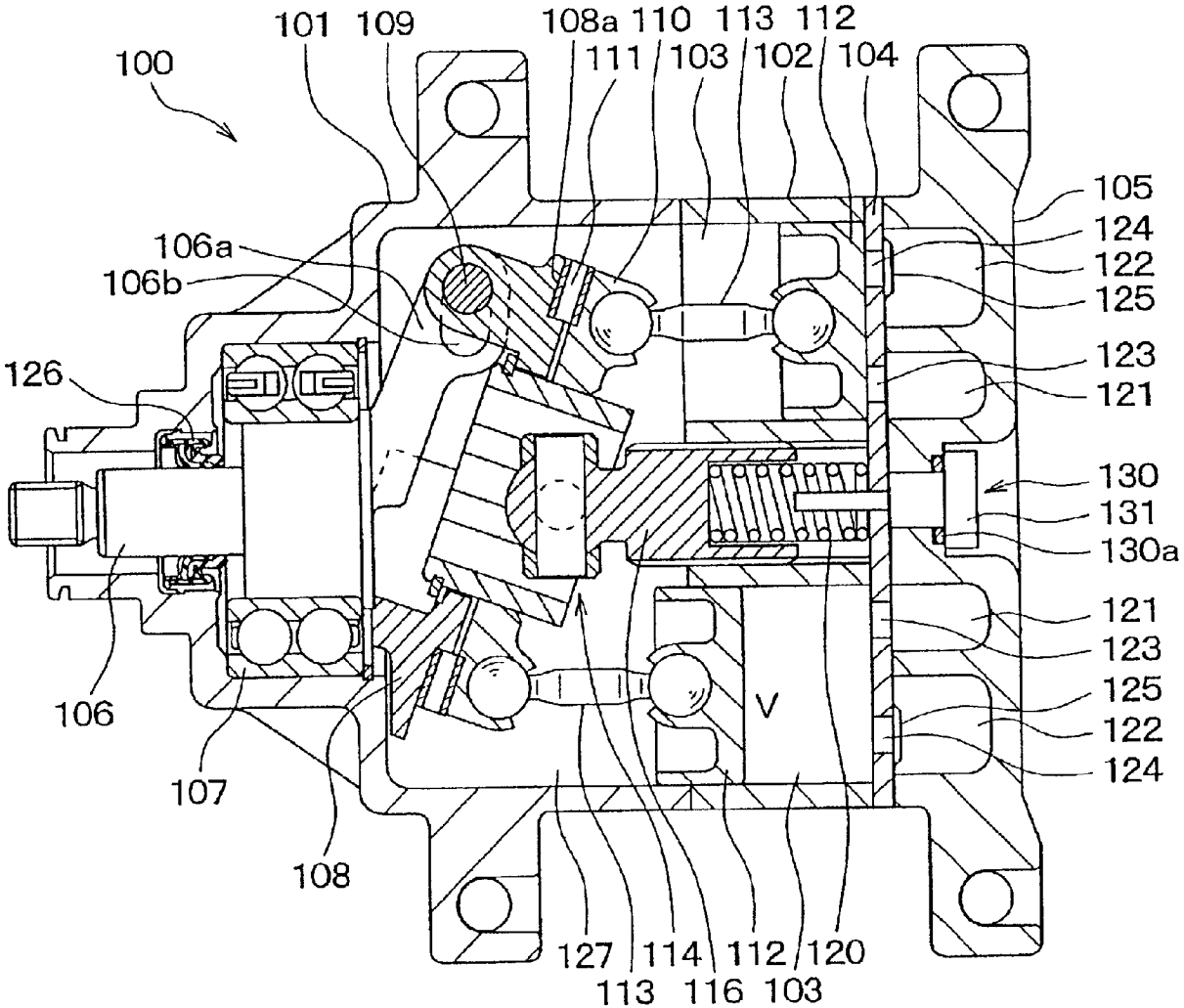
FIG. 8 is a cross-sectional view showing a compressor being operated at a maximum discharge capacity (third embodiment)

In the third embodiment, as shown in FIG. 8, a discharge capacity detecting mechanism 130 is provided for detecting the discharge capacity (slant angle θ of the swing member 110).

Figure 9:
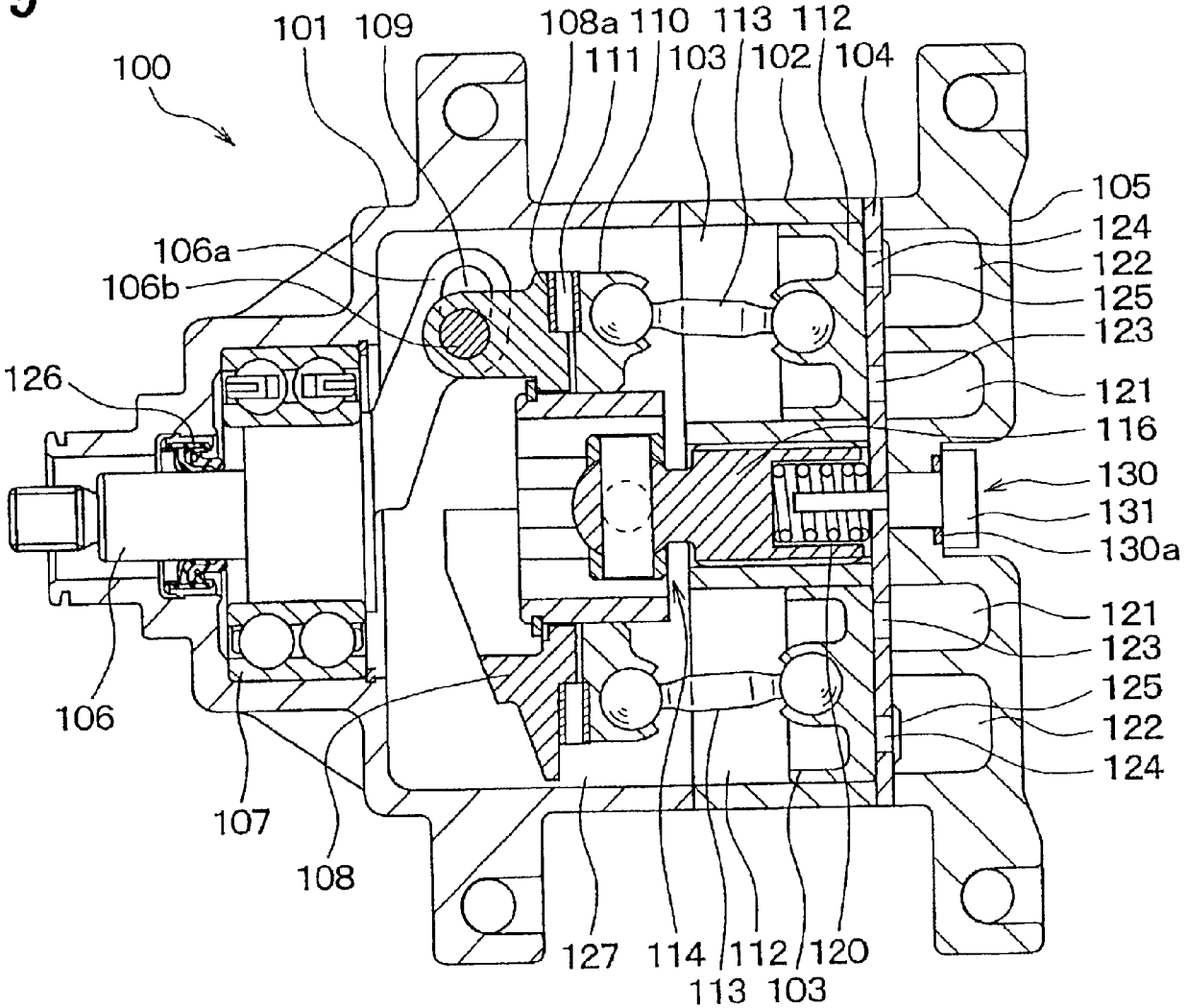
FIG. 9 is a cross-sectional view showing the compressor being operated at a minimum discharge capacity (third embodiment)
Figure 10:
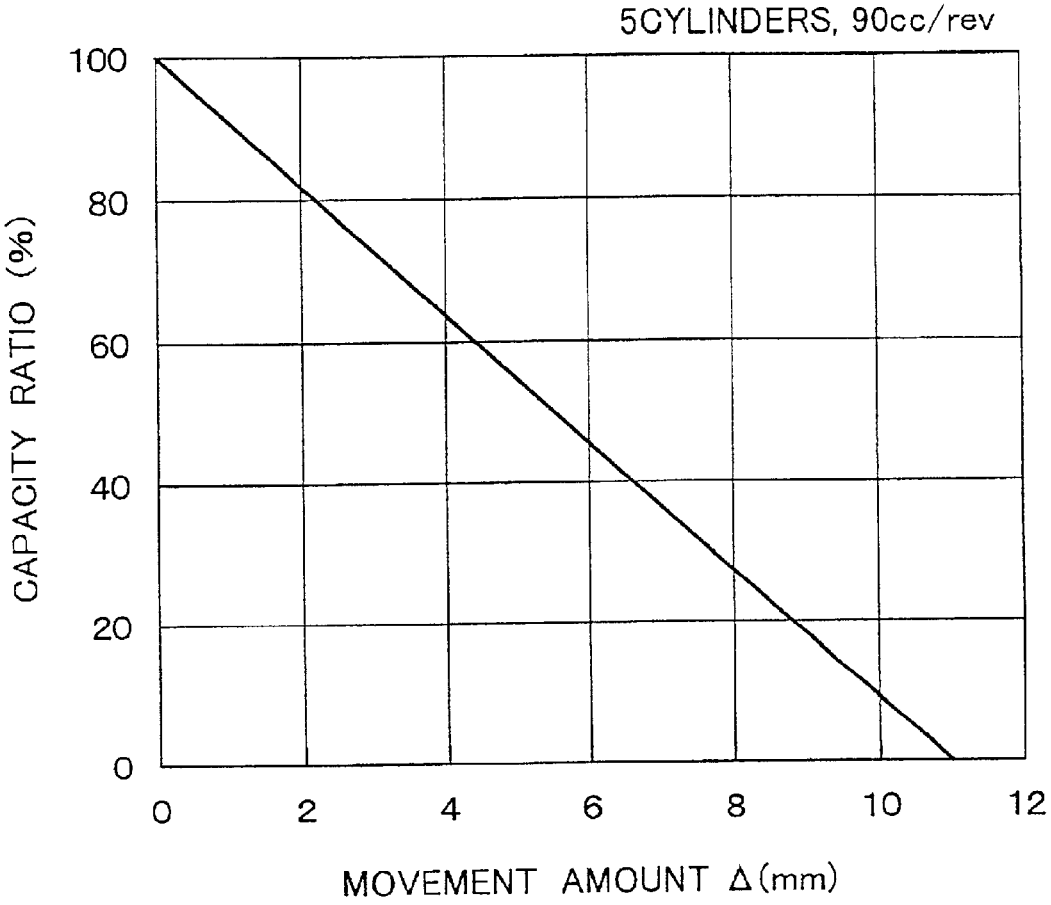
FIG. 10 is a graph showing a relationship between an amount of movement Δ of a constraining member and ratio of discharge capacity Q (third embodiment)

That is, as can be seen from FIGS. 8 and 9, the center of the swing member 110 is shifted in the longitudinal direction of the shaft 106 in response to a change in the discharge capacity (slant angle θ). In the third embodiment, as shown in FIG. 10, the ratio of discharge capacity Q is nearly proportional to the amount of movement Δ of the constraining member 116. Here, the ratio of discharge capacity Q means a discharge capacity expressed by a percent when the maximum discharge capacity is assumed to be one hundred.

Accordingly, in the present third embodiment, a displacement sensor 131 is provided for detecting the amount of movement Δ of the constraining member 116 as the discharge capacity detecting mechanism 130 in the rear housing 105, and the discharge capacity is calculated based on the detection signal of the displacement sensor 131.

Here, an O-ring 130*a* is provided for sealing. The calculated discharge capacity is utilized as a feedback signal for controlling the displacement and the like.

Since the top dead center position of the piston 112 is set almost at a fixed position irrespective of the slant angle θ, the ratio of discharge capacity Q is nearly proportional to the amount of movement Δ of the constraining member 116. However, in the case where the top dead center position of the piston 112 is shifted in accordance with the slant angle θ, the ratio of discharge capacity Q is not always nearly proportional to the amount of movement Δ of the constraining member 116. It is necessary to calculate the discharge capacity, taking into account of this fact.

(Fourth Embodiment)

In the fourth embodiment, a differential transformer mechanism is used as the discharge capacity detecting mechanism 130.

Figure 11:
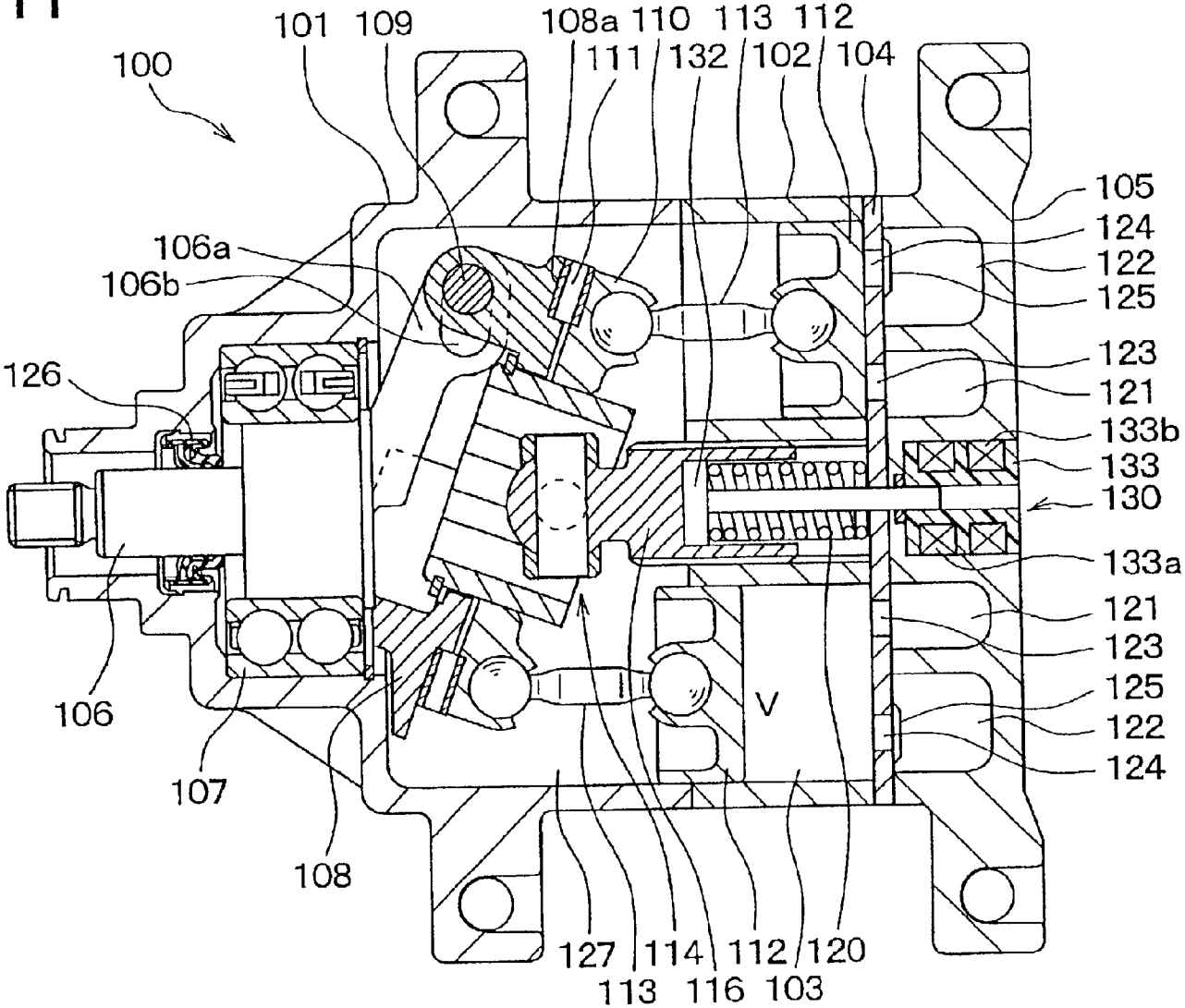
FIG. 11 is across-sectional view showing a compressor being operated at a maximum discharge capacity (fourth embodiment)
Figure 12B:
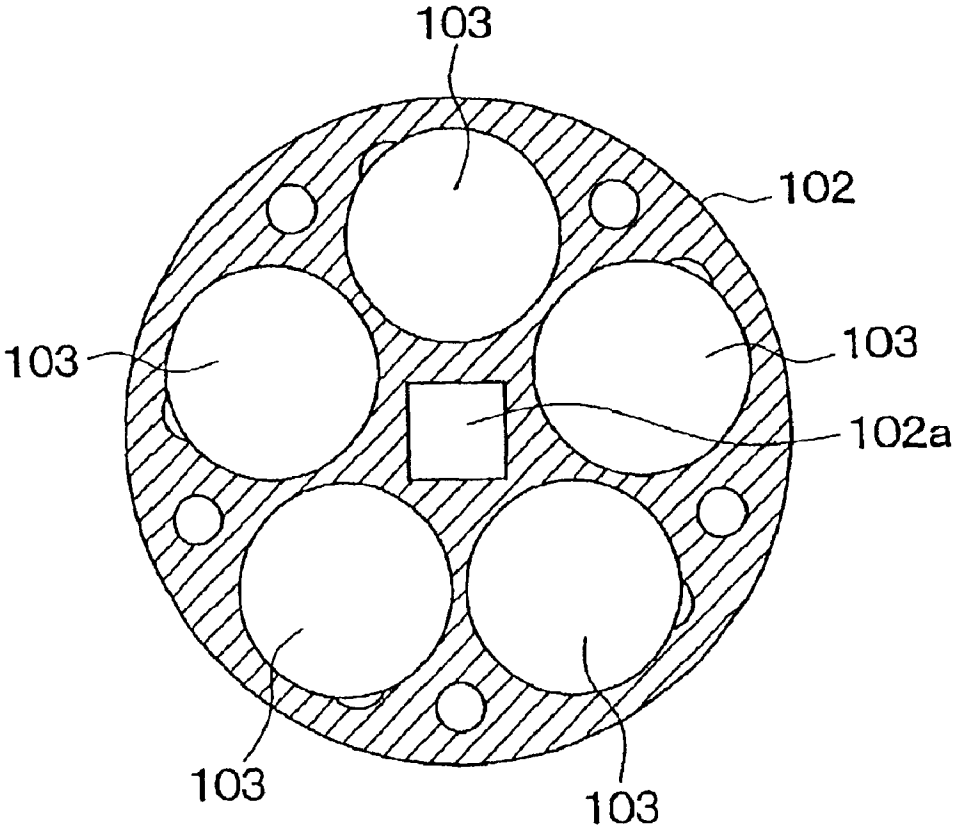
FIG. 12B is a front view showing the middle housing (fifth embodiment)
Figure 12A:
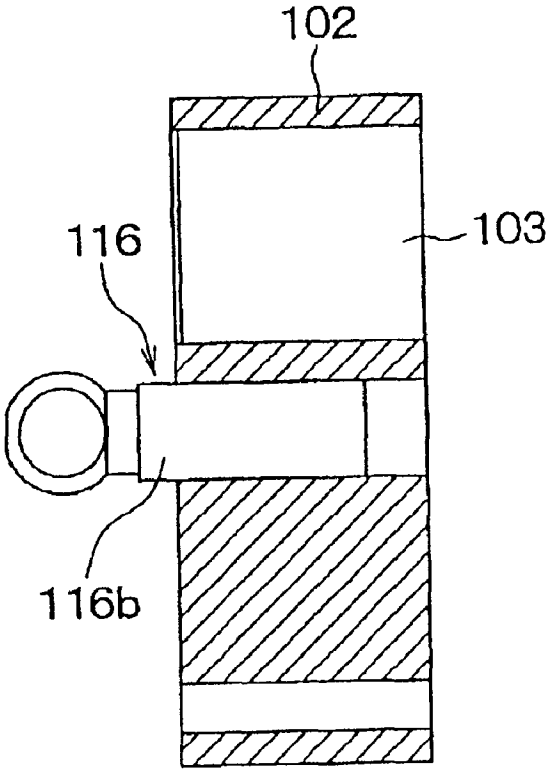
FIG. 12A is cross-sectional view in the axial direction of a middle housing (fifth embodiment)
Figure 13B:
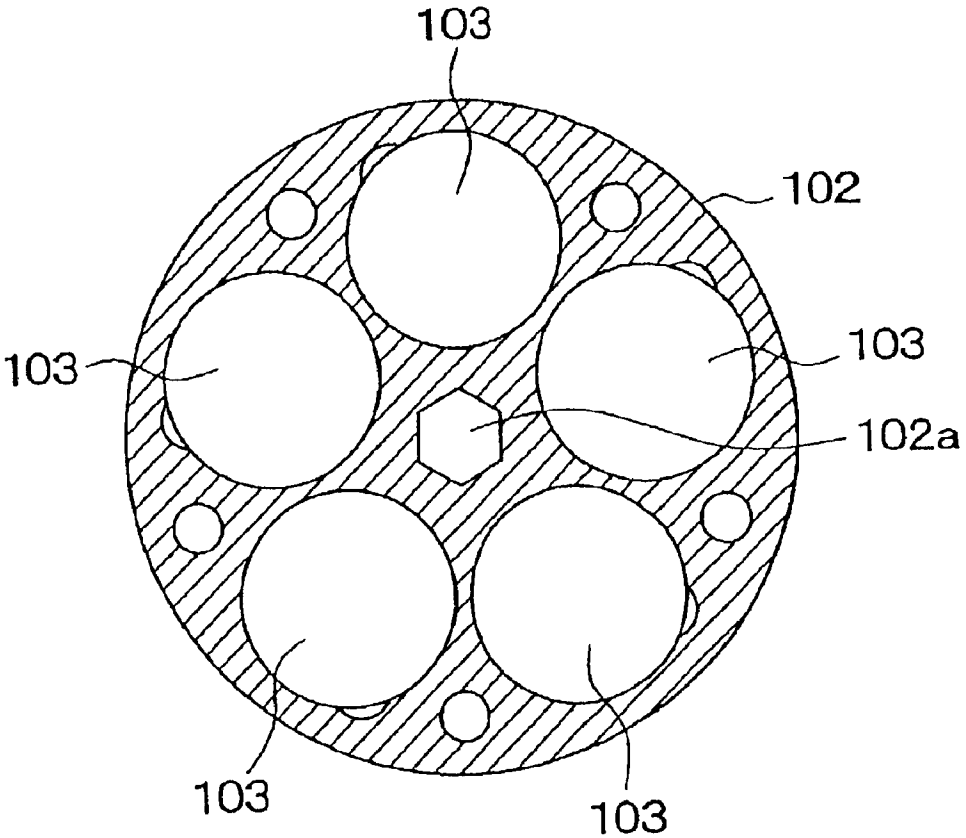
FIG. 13B is a front view showing the middle housing (fifth embodiment)
Figure 13A:
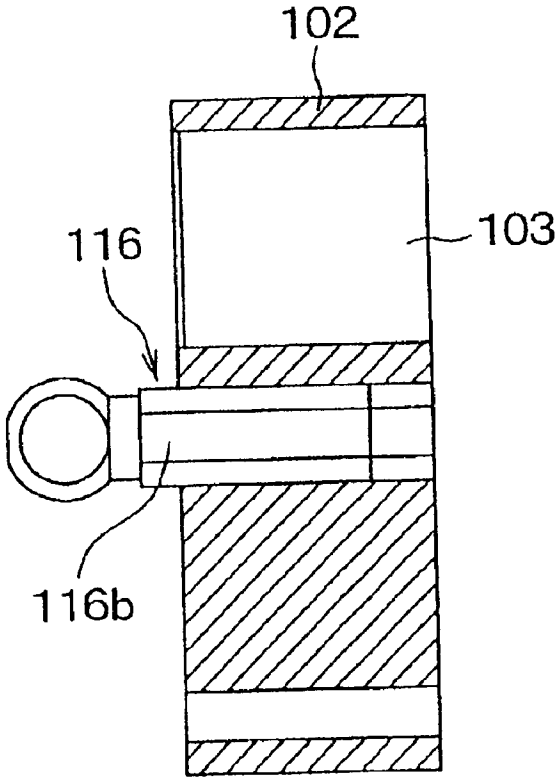
FIG. 13A is a cross-sectional view in the axial direction showing a middle housing (fifth embodiment)

As shown in FIG. 11, the differential transformer mechanism includes a sensing rod 132 made of a magnetic material and displaced integrally with the constraining member 116, a coil holder 133 made of non-magnetic material such as resin, and the first and second coils 133*a*, 133*b* disposed separately from each other in the direction of movement of the sensing rod 132. The differential transformer mechanism detects the amount of movement Δ of the constraining member 116 by the output voltage of the differential transformer changing in accordance with the displacement of the sensing rod 132.

(Fifth Embodiment)

The constraining member 116 is prevented from rotating by the fit in the spline in the above-described embodiments. In the fifth embodiment, as shown in FIGS. 12A, 12B, 13A and 13B, the constraining member 116 is prevented from rotating by the polygonal cross section of the supporting part 116*b* of the constraining member 116.

(Sixth Embodiment)

Figure 14B:
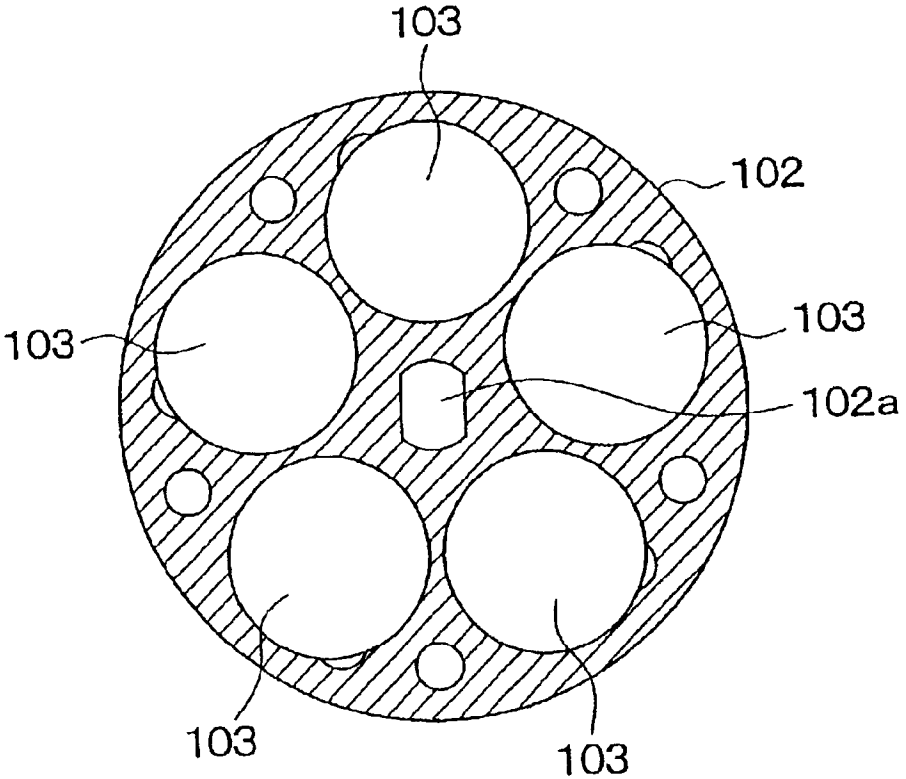
FIG. 14B is a front view showing the middle housing (sixth embodiment)
Figure 14A:
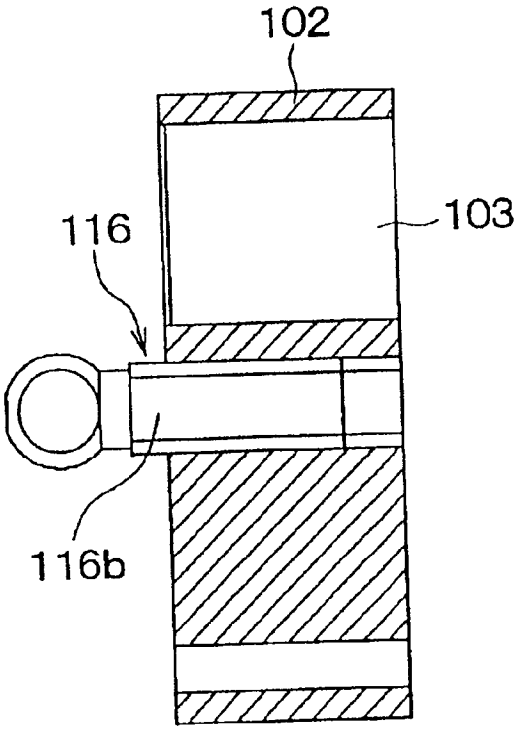
FIG. 14A is a cross-sectional view in the axial direction showing a middle housing (sixth embodiment)

In the sixth embodiment, as shown in FIGS. 14A and 14B, the constraining member 116 is prevented from rotating by a width across flat provided on the supporting part 116*b*.

(Seventh Embodiment)

Figure 15:
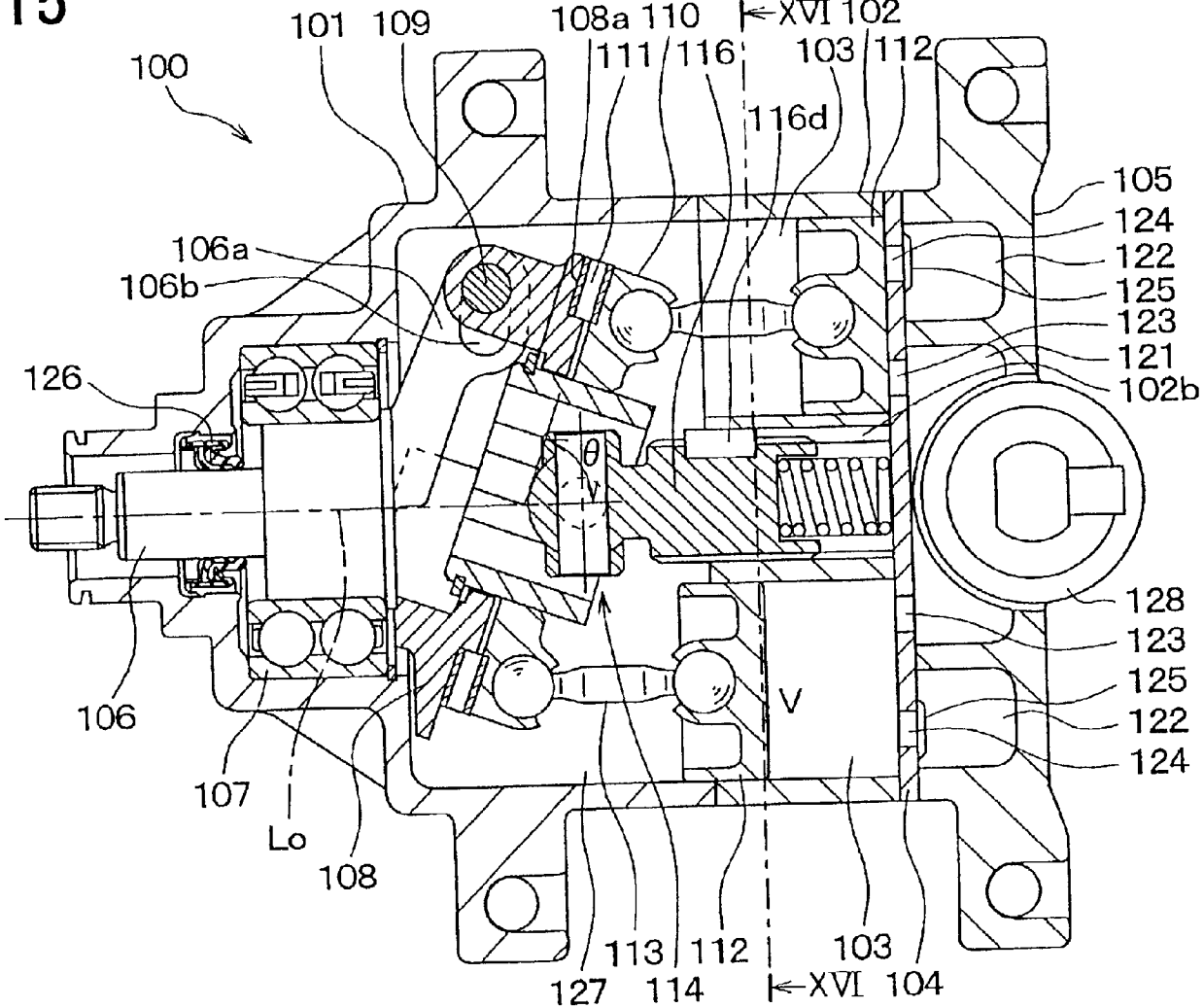
FIG. 15 is a cross-sectional view showing a compressor and is a cross-sectional view taken along line XV—XV in FIG. 16 (seventh embodiment)
Figure 16:
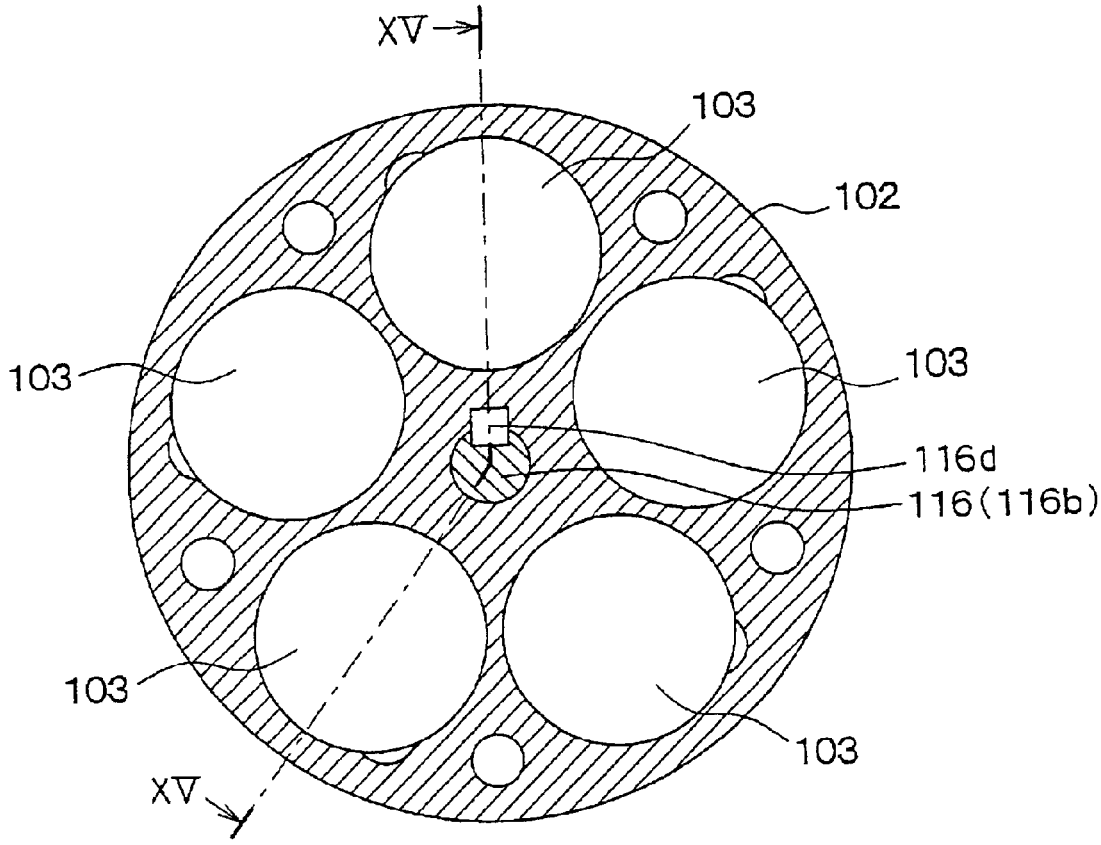
FIG. 16 is a cross-sectional view taken along line XVI—XVI in FIG. 15 (seventh embodiment)

In the seventh embodiment, as shown in FIGS. 15 and 16, the hole 102*a* includes a key groove 102*b*, and a key 116*d* is provided on the support part 116*b* of the constraining member 116 and is fitted into the key groove 102*b* to prevent the constraining member 116 from rotating.

(Eighth Embodiment)

The piston 112 is connected to the swing member 110 by the rod 113 in the above-described embodiments. In the eighth embodiment, as shown in FIGS. 17 and 18, the rod 113 is eliminated and a disc-like swash plate 113*a* integrally swung with the swing member 110 is provided, and shoes 113*b* are provided which are in slidable contact with the outside diameter side of the swash plate 113*a* and the piston 112 and connects the piston 112 to the swash plate 113*a* such that it can swing.

Figure 17:
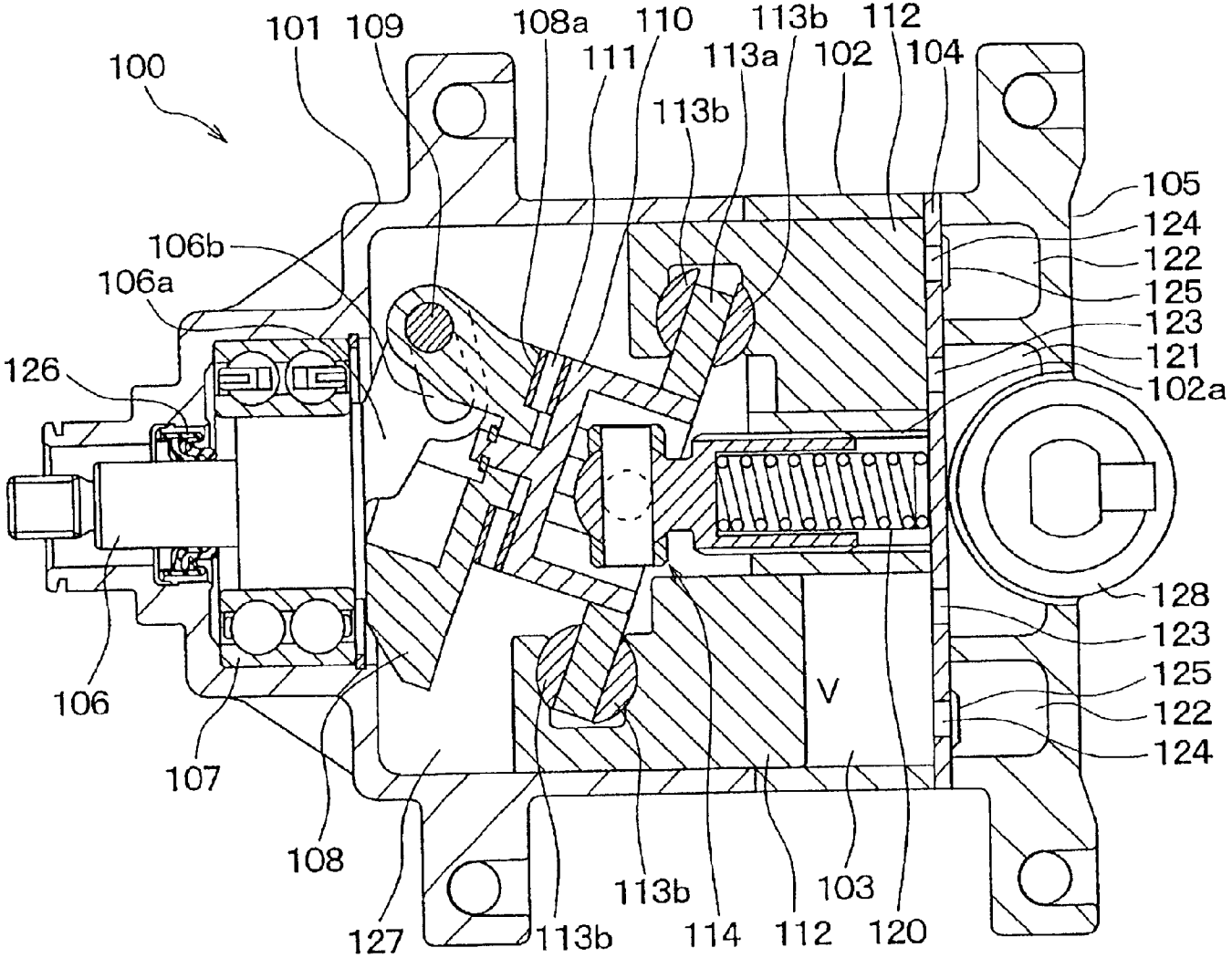
FIG. 17 is a cross-sectional view showing a compressor being operated at a maximum discharge capacity (eighth embodiment)
Figure 18:
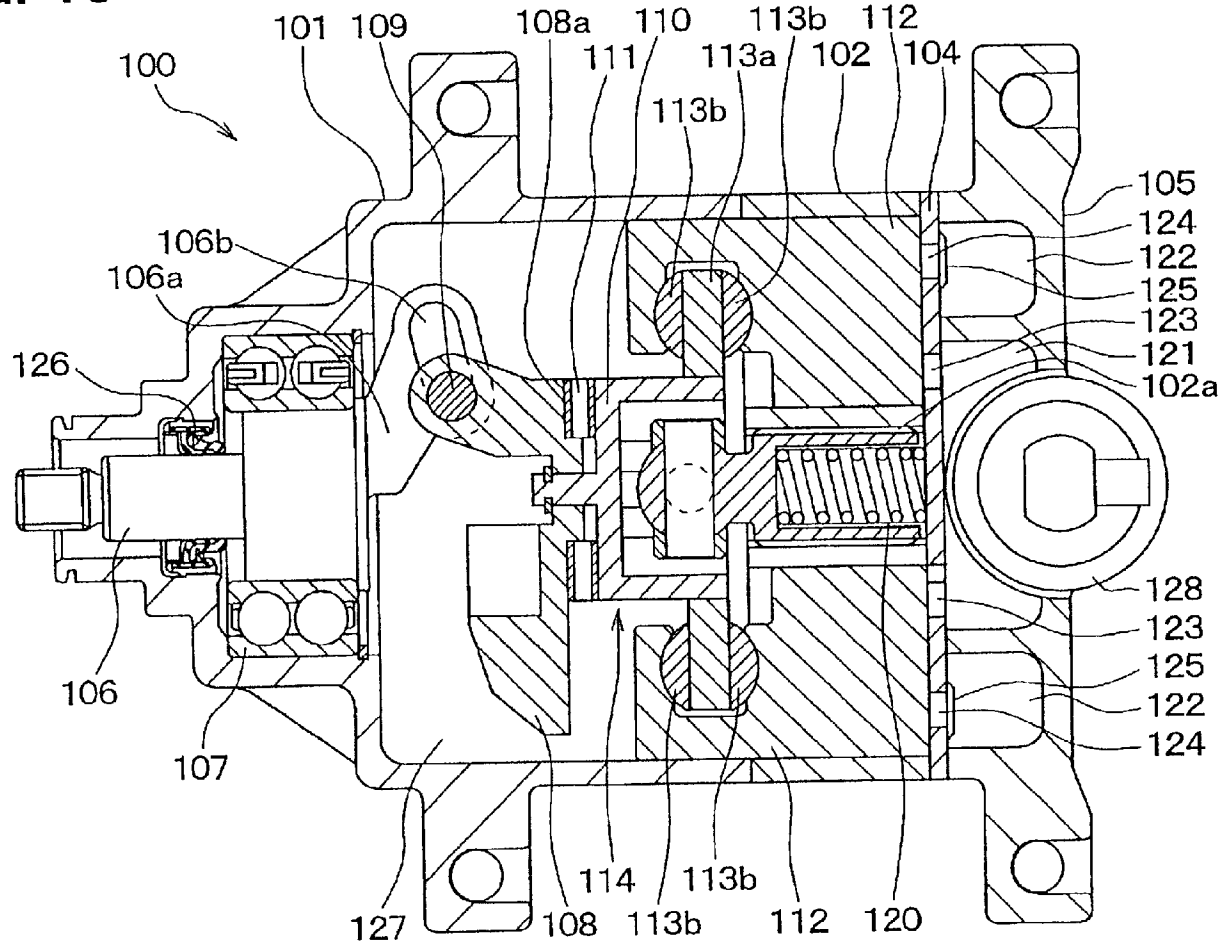
FIG. 18 is a cross-sectional view showing the compressor being operated at a minimum discharge capacity (eighth embodiment).

Here, FIG. 17 shows the state when the compressor is operated at a discharge capacity of 100%, and FIG. 18 shows the state when the compressor is operated at a discharge capacity of 0% (minimum).

(Modifications)

In the above-described embodiments, the swing support mechanism 114 is formed by a universal joint shaped like a Hook's joint hook. Alternatively, a joint which has a rolling member such as an equivalent speed ball joint may be used.

In the above-described embodiments, the electromagnetic clutch 100*a* transmits the rotating force of the engine E/G to the compressor 100. Alternatively, the electromagnetic clutch may be omitted and replaced with a mere rotation transmitting apparatus, because the compressor 100 in the present invention can change the discharge capacity.

In the above-described embodiments, the present invention is applied to the compressor for the compression type refrigeration cycle. Alternatively, the present invention may be applied to any other fluid pump or compressor.

What is claimed is:

1. A fluid pump comprising:

a housing;

a shaft rotatably supported by said housing, said shaft extending in a center line and having an arm in said housing;

a cylinder bore formed within said housing;

a piston accommodated in said cylinder bore, said piston reciprocating in said cylinder bore;

a swing member disposed in said housing and driven by said shaft in swing motion to reciprocate said piston; and a support mechanism for supporting said swing member such that said swing member swings with a variable swing angle, wherein said support mechanism includes:

a constraining member supported on said housing in a movable manner along the center line and in an immovable manner around the center line, said constraining member defining a through hole in a first axis perpendicular to the center line;

a first ring member disposed around said constraining member, said first ring member defining a pair of first through holes on the first axis and a pair of second through holes on a second axis that is perpendicular to both of the center line and the first axis an crosses with both of the center line and the first axis;

a first pin disposed on the first axis, said first pin passing through said through hole defined on said constraining member and said pair of first through holes so as to support said first ring member on said constraining member in a rocking manner;

a second ring member firmly connected to said swing member and disposed around said first ring member, said second ring member defining a pair of third through holes on the second axis, wherein the constraining member includes at first contact surface, at which the constraining member contacts an opposing surface first ring member, and the first ring member includes a second contact surface, at which the first ring member contacts an opposing surface of the second ring member, and radial compression reaction forces, which occur during operation of the fluid pump, are received by the first and second contact surfaces; and a pair of second pins disposed on the second axis, each of said second pins passing through said second through hole defined on said first ring member and said third through hole defined on said second ring members so as to support said second ring member said first ring member in a rocking manner.

2. A fluid pump according to claim 1, wherein said swing member is connected to an orbiting member having a slant plane, wherein the slant plane is inclined with respect to the shaft so that the swing member is driven by said shaft through the orbiting member;

said orbiting member is connected to said shaft such that a slant angle formed by said slant plane and the center line changes; and said constraining member is located in said housing to move in a direction of the center line.

3. A fluid pump according to claim 2, further comprising a discharge capacity detecting mechanism for detecting a discharge capacity based on an amount of displacement of said constraining member.

4. A fluid pump according to claim 2, wherein:

said constraining member is cylindrically formed, and of which cross section is polygonal;

said housing includes a hole having a cross section similar to the cross section of said constraining member; and said constraining member is slidably inserted into the hole.

5. A fluid pump according to claim 2, wherein:

said constraining member is cylindrically formed, and of which cross section is shaped like a gear;

said housing includes a hole having a cross section similar to the cross section of said constraining member; and said constraining member is slidably inserted into the hole.

6. A fluid pump according to claim 2, wherein said constraining member is prevented from rotating with respect to said housing by a key fit and slides in the direction of the center line.

7. A fluid pump according to claim 1, wherein:

said swing member is formed in a ring disc; and said support mechanism is located near a center of said swing member.

* * * * *